US007080761B1

(12) United States Patent
Yu

(10) Patent No.: US 7,080,761 B1
(45) Date of Patent: Jul. 25, 2006

(54) SPRAY HEAD STRUCTURE CAPABLE OF PREVENTING BACKFLOW OF PERFUME LIQUID

(75) Inventor: Yuan-Wen Yu, Taoyuan Hsien (TW)

(73) Assignee: Ing Wen Precision Ent. Co., LTD, Taoyuan Hsin (TW)

( * ) Notice: Subject to any disclaimer, the term of this patent is extended or adjusted under 35 U.S.C. 154(b) by 0 days.

(21) Appl. No.: 11/269,732

(22) Filed: Nov. 9, 2005

(51) Int. Cl.
*B05B 11/06* (2006.01)

(52) U.S. Cl. ..... 222/633; 222/209; 239/318; 239/434

(58) Field of Classification Search ..... 222/401–402, 222/394, 400.8, 630–633, 153.04, 153.02, 222/153.14, 153.11, 153.12, 209, 261; 239/431, 239/433, 434, 318; 137/888, 892, 510–512
See application file for complete search history.

(56) References Cited

U.S. PATENT DOCUMENTS 1,373,505 A * 4/1921 Holland ..... 137/512
1,825,608 A * 9/1931 Shaukis ..... 239/353
1,877,252 A * 9/1932 Patou ..... 239/363
1,968,316 A * 7/1934 Schmitt ..... 222/153.08
2,034,089 A * 3/1936 De Maublanc ..... 239/363
2,213,522 A * 9/1940 Holmboe et al. ..... 239/434
2,246,211 A * 6/1941 Kilich ..... 239/10
2,275,972 A * 3/1942 Maloney ..... 222/207
2,342,940 A * 2/1944 Janke ..... 222/209
2,575,632 A * 11/1951 Lipman ..... 222/633
2,578,463 A * 12/1951 Croce ..... 215/313
2,616,762 A * 11/1952 Holmes ..... 239/362
2,665,170 A * 1/1954 Schmitt et al. ..... 239/353
2,755,132 A * 7/1956 Croce ..... 239/346
2,814,419 A * 11/1957 Lipman ..... 222/207
2,837,374 A * 6/1958 Lipman ..... 239/354
2,886,199 A * 5/1959 Lipman ..... 215/317
3,770,209 A * 11/1973 Wilcox ..... 239/434
4,116,382 A * 9/1978 Clerk ..... 239/8
4,123,005 A * 10/1978 Blunk ..... 239/327
5,318,205 A * 6/1994 Delaney, Jr. ..... 222/211
5,738,254 A * 4/1998 de la Guardia ..... 222/400.8
6,042,026 A * 3/2000 Buehler, II ..... 239/346
6,094,778 A * 8/2000 Boukas ..... 15/409
6,616,067 B1 * 9/2003 Hunter ..... 239/338
6,991,136 B1 * 1/2006 de la Guardia ..... 222/209

* cited by examiner

*Primary Examiner*—Frederick C. Nicolas
(74) *Attorney, Agent, or Firm*—Troxell Law Office, PLLC

(57) ABSTRACT

A spray head structure capable of preventing backflow of perfume liquid comprises a spray head, a locking base, a kit, a bottle, and a compressible ball. A rolling ball is held inside a gas-supplying tube of the spray head. A cross-shaped trench is formed on one end of a gas-guiding device, and several liquid-guiding grooves are formed on the other end of the gas-guiding device. The cross-shaped trench supplies the gas with a flow channel, and it also prevents the rolling ball from blocking the channel. If the compressed compressible ball is released, the rolling ball will be attracted backward by suction force such that the rolling ball blocks the flow channel and prevents the perfume liquid from flowing into the inside of the compressible ball.

5 Claims, 7 Drawing Sheets

SPRAY HEAD STRUCTURE CAPABLE OF PREVENTING BACKFLOW OF PERFUME LIQUID

FIELD OF THE INVENTION

The present invention relates to a spray head structure capable of preventing backflow of perfume liquid, and more particularly to a spray head structure that can simply prevents backflow of perfume liquid during operation.

BACKGROUND OF THE INVENTION

The perfume liquid is taken out by dropping or spraying method, or it may be taken out by use of a compressible ball that attaches to a perfume bottle, wherein the perfume liquid is sprayed out by gas that stores in the compressible ball. When the gas is squeezed out of the spray nozzle by compressing the compressible ball, the perfume liquid is also sprayed out from the perfume bottle to form a uniform mist. However, a backward suction force is generated when the compressed compressible ball is released. As a result, some perfume liquid will be sucked into the compressible ball by the backward suction force. Accordingly, the perfume liquid that remains in the compressible ball may be degenerated, and the degenerated perfume liquid will be sprayed out if the compressible ball is compressed again.

SUMMARY OF THE INVENTION

In view of the above-mentioned problems, the present inventor mounts a simple control structure on the gas-supplying tube of the compressible ball to overcome the conventional perfume backflow problem of the compression-type spray head structure.

In accordance with one aspect of the present invention, a spray head structure capable of preventing backflow of perfume liquid comprises a spray head, a locking base, a kit, a bottle, and a compressible ball. A rolling ball is held inside a gas-supplying tube of the spray head. A cross-shaped trench is formed on one end of a gas-guiding device, and several liquid-guiding grooves are formed on the other end of the gas-guiding device. The cross-shaped trench supplies the gas with a flow channel, and it also prevents the rolling ball from blocking the channel. If the compressed compressible ball is released, the rolling ball will be attracted backward by suction force such that the rolling ball blocks the flow channel and prevents the perfume liquid from flowing into the inside of the compressible ball.

Other objects and features of the present invention will become apparent from the following detailed description when taken in conjunction with the drawings in which:

BRIEF DESCRIPTION OF THE DRAWINGS

These and other features, aspects and advantages of the present invention will become better understood with regard to the following description, appended claims, and accompanying drawings, wherein:

DETAILED DESCRIPTION OF THE PREFERRED EMBODIMENT

Figure 1:
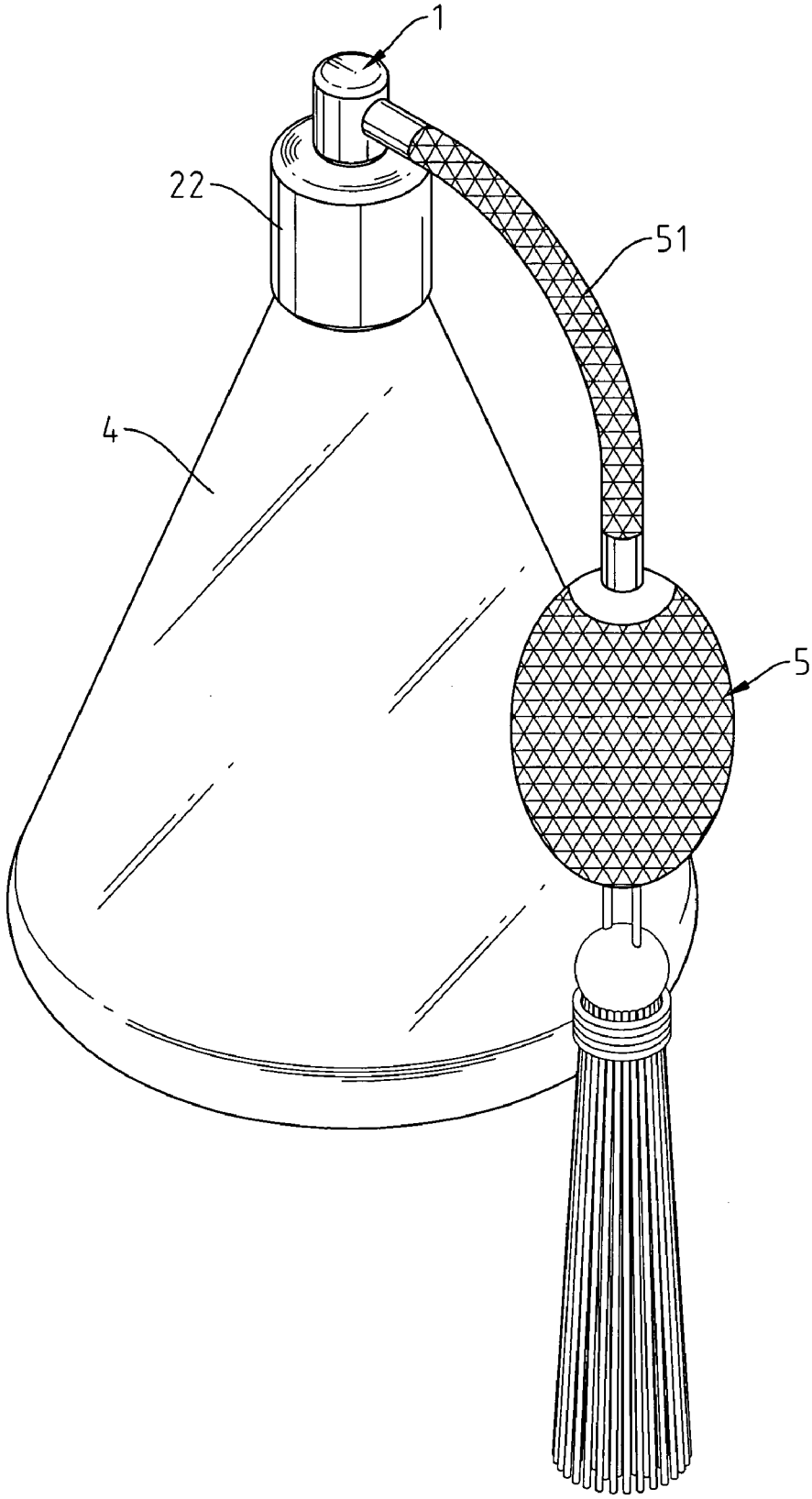
FIG. 1 is an elevational view showing that the spray head structure of the present invention is coupled with the perfume bottle.
Figure 2:
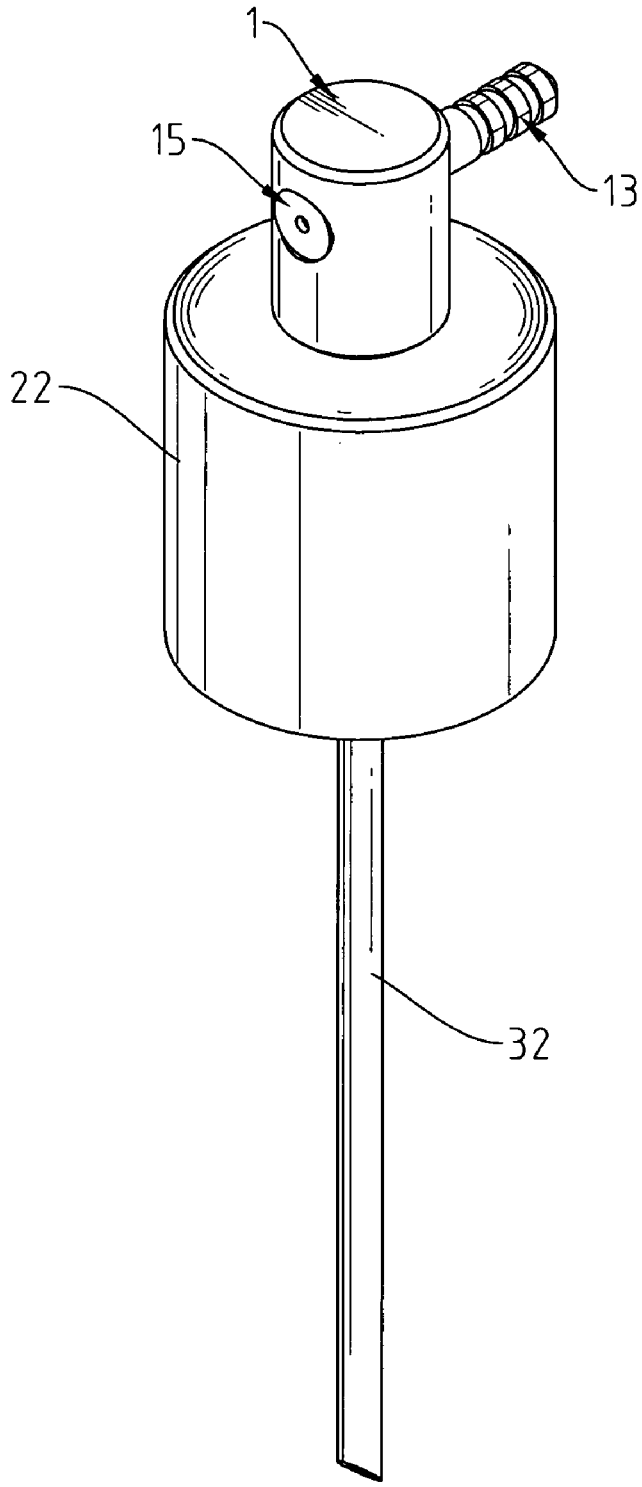
FIG. 2 is an elevational view showing the spray head of the present invention.
Figure 3:
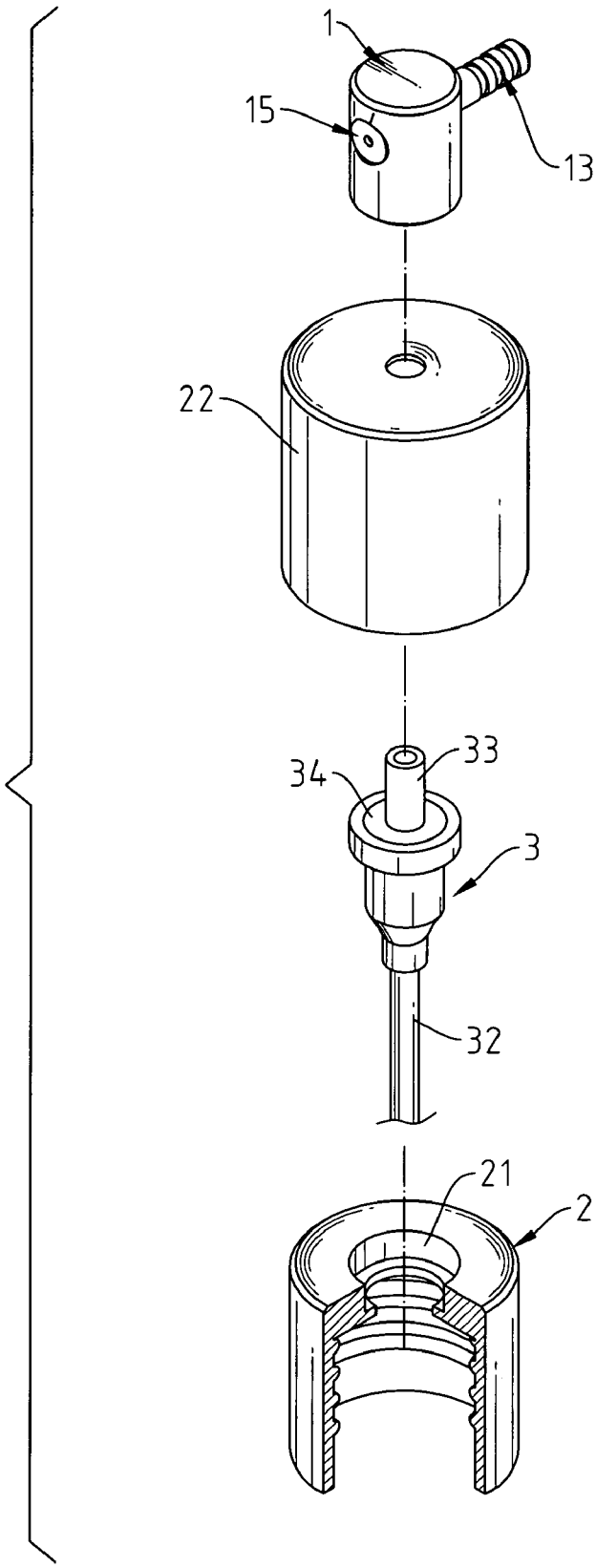
FIG. 3 is an exploded elevational view showing the spray head shown in FIG. 2.

Referring to FIG. 1, FIG. 2 and FIG. 3, a spray head structure of the present invention that prevents backflow of perfume liquid comprises a spray head 1, a locking base 2, a kit 3, a bottle 4, and a compressible ball 5, wherein the locking base 2 is coupled to the bottle 4. The locking base 2 has a trench 21 formed thereon for holding the kit 3, wherein the locking base 2 is covered with an outer cover 22 and the kit 3 is fixedly inserted into the locking base 2 such that the kit 3 is coupled with the spray head 1. An extension tube 51 that extends from the spray head 1 is coupled with the compressible ball 5 such that the gas stored in the compressible ball 5 can be utilized to spray out the perfume liquid.

Figure 4:
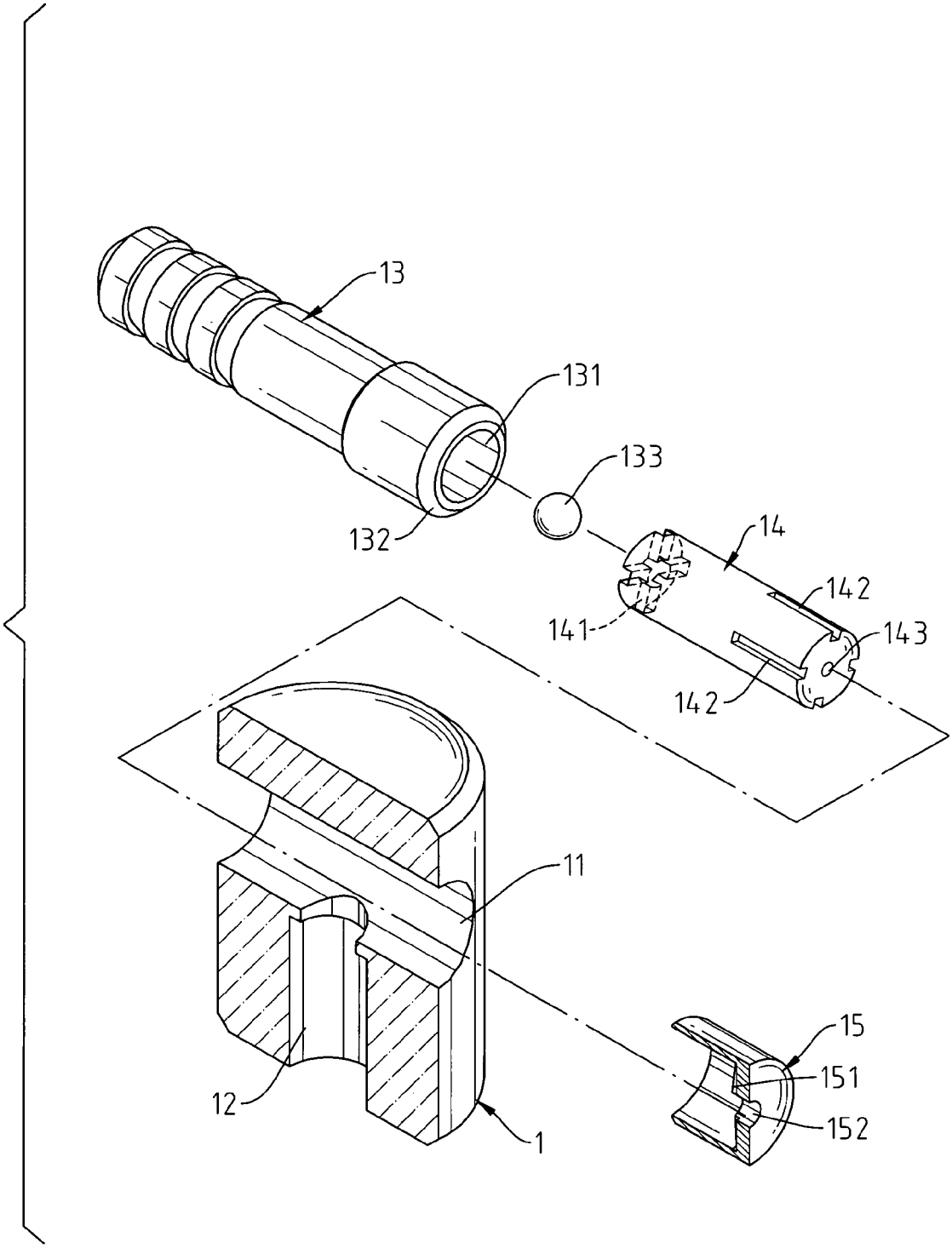
FIG. 4 is an exploded elevational view showing the spray head structure of the present invention.
Figure 5:
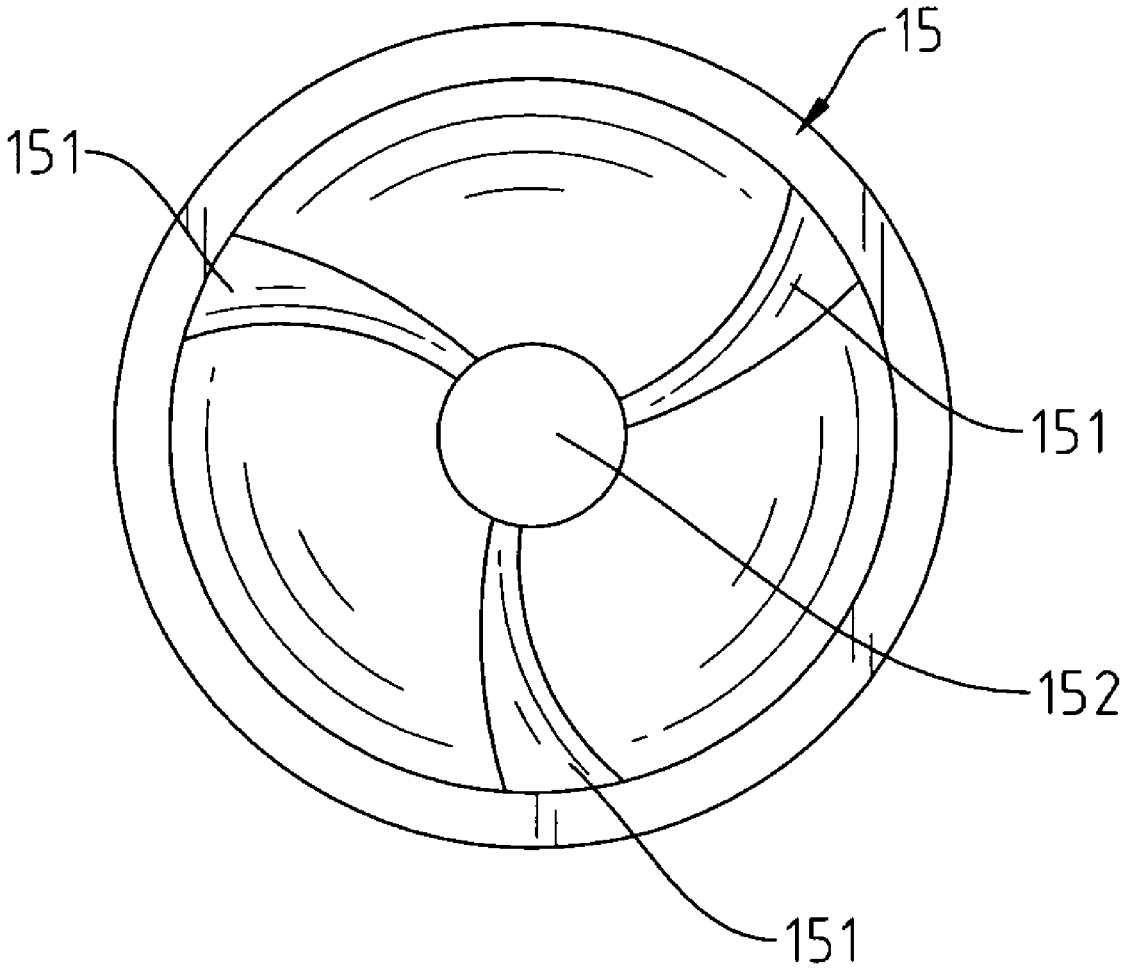
FIG. 5 is a schematic plane view showing the inside of the spray head structure of the present invention.

FIG. 3, FIG. 4 and FIG. 5 illustrate the detailed structure of the spray head 1. The spray head 1 has a horizontal tunnel 11 and a vertical tunnel 12, which are connected to one another, wherein the horizontal tunnel 11 is designed for holding a gas-supplying tube 13, a gas-guiding device 14, and a spray nozzle 15. The spray nozzle 15 is located on one side of the horizontal tunnel 11. The spray nozzle 15 has a spray hole 152, and several grooves 151 are formed on an inner surface of the spray nozzle 15 adjacent to the spray hole 152, wherein the grooves 151 are connected to several liquid-guiding grooves 142 of the gas-guiding device 14.

The above-mentioned gas-supplying tube 13 has a through inside, wherein an expansion hole 131 is formed on one side of the gas-supplying tube 13, and a guide surface 132 is formed on an outer edge of the expansion hole 131. A rolling ball 133 is held in the expansion hole 131, and movably located inside the gas-supplying tube 13. The gas-guiding device 14 is inserted into the expansion hole 131, and coupled with the gas-supplying tube 13. A cross-shaped trench 141 is formed on one end of the gas-guiding device 14, and the above-mentioned liquid-guiding grooves 142 are formed on the other end of the gas-guiding device 14. If the gas-guiding device 14 is coupled to the inside of the gas-supplying tube 13, the cross-shaped trench 141 of the gas-guiding device 14 is coupled with the expansion hole 131 and the liquid-guiding grooves 142 are coupled with the spray nozzle 15. Therefore, the gas-guiding device 14 is located between the gas-supplying tube 13 and the spray nozzle 15, and a gap is formed between the gas-supplying tube 13 and the spray nozzle 15 such that they are not closely coupled with one another. Moreover, a liquid channel 10 is formed between the gas-guiding device 14 and the spray nozzle 15, and the liquid channel 10 is connected to the vertical tunnel 12 of the spray head 1 so as to provide the perfume with a flow channel.

Figure 6:
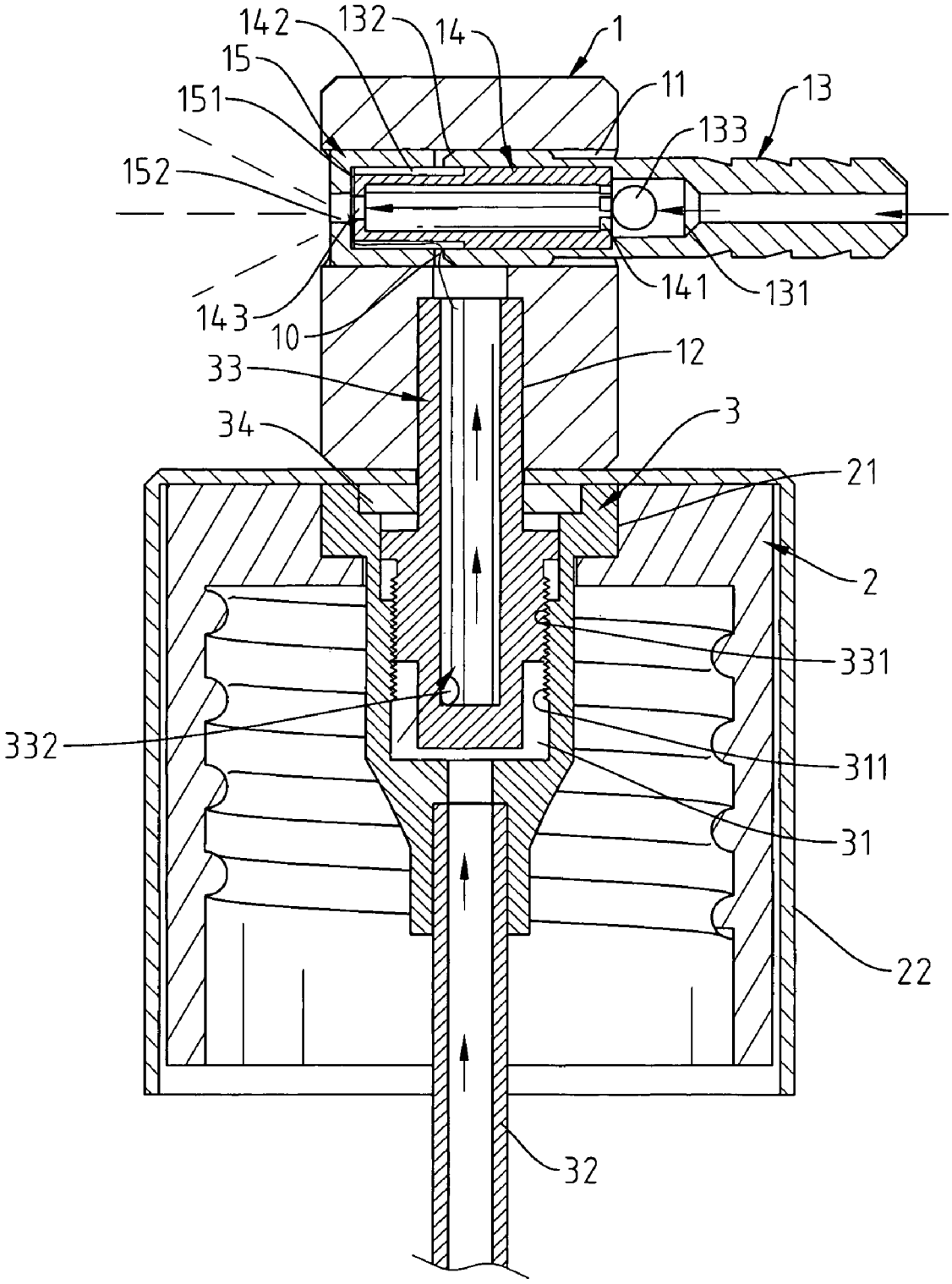
FIG. 6 is a schematic view showing that the liquid is sprayed out from the spray head structure of the present invention.

Referring further to FIG. 3 and FIG. 6, the kit 3 is mounted between the spray head 1 and the locking base 2, wherein a liquid straw 32 is attached to the lower end of the kit 3. Several inner threads 311 are formed on the inner surface of the kit 3 corresponding to a liquid container 31 that forms on the upper opening of the kit 3. A liquid-guiding device 33 is held in the liquid container 31, and the liquid-guiding device 33 has a sealed lower end on which a through hole 332 is formed. A thread portion 331 is formed on the outer periphery of the liquid-guiding device 33 for engagement with the inner threads 311 such that it is able to control the supply of the perfume liquid by screwing operation. In order to prevent the liquid-guiding device 33 from being pushed out, a fixing plate 34 is mounted on the connection portion between the kit 3 and the outer cover 22.

FIG. 1 and FIG. 6 illustrate the spraying operation of the perfume liquid. If there is a need to spray out the perfume liquid, the compressible ball 5 is compressed such that the gas stored inside the compressible ball 5 is guided into the inside of the spray head 1 so as to shift the rolling ball 133 to the cross-shaped trench 141. As a result, the gas is able to flow into the gas-guiding device 14 via the cross-shaped trench 141 such that the perfume liquid that locates originally at the spray nozzle 15 can be carried out by the gas to form uniformly mist. Furthermore, the perfume liquid flows from the through hole 332 to the liquid-guiding device 33 of the kit 3 via the liquid straw 3, and then flows to the liquid channel 10 continuously. Accordingly, a proper amount of perfume liquid is sprayed out when the compressible ball 5 is compressed.

Figure 7:
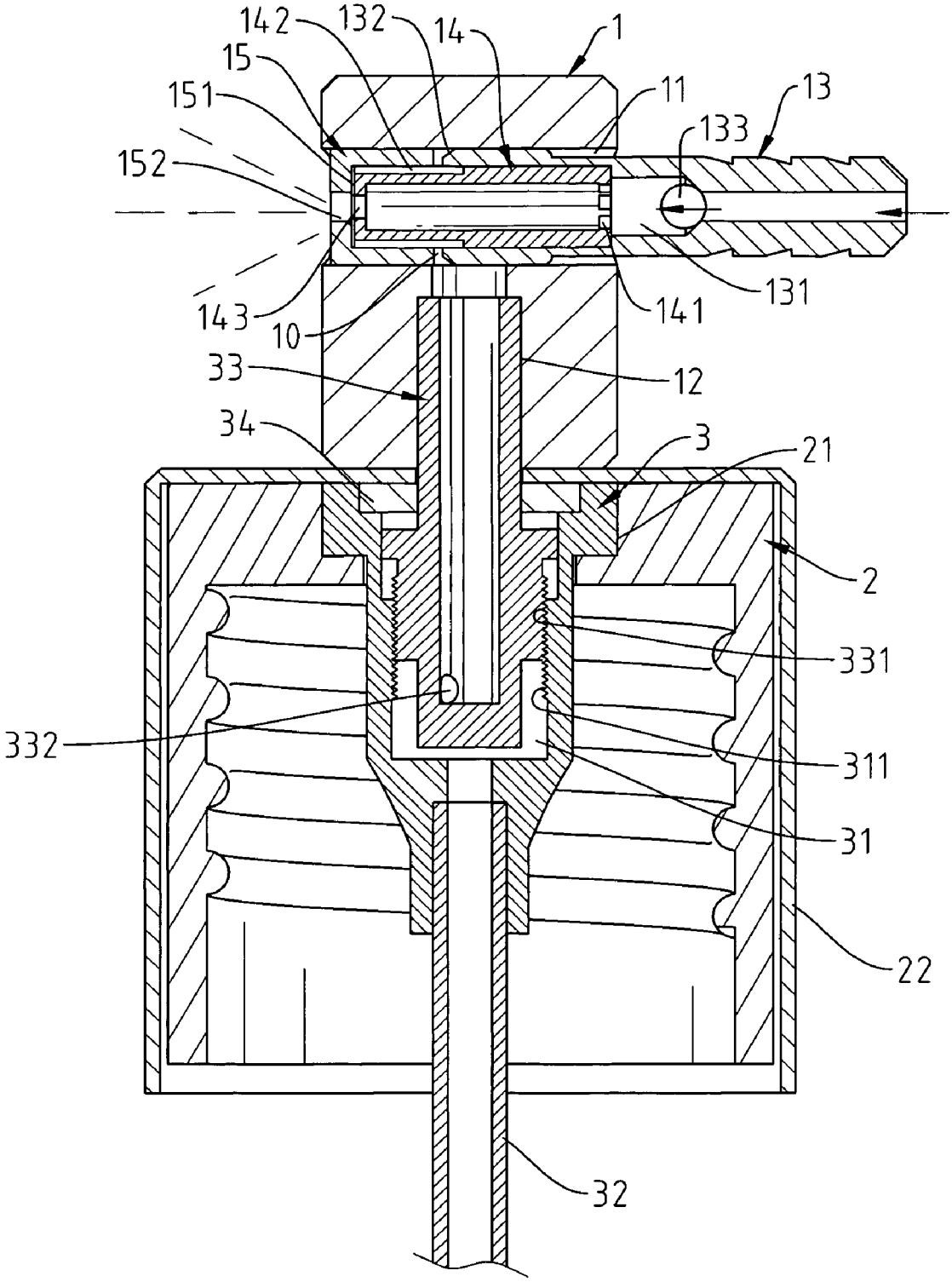
FIG. 7 is a schematic view showing that the spray head structure of the present invention prevents the liquid from backflow.

Referring further to FIG. 7, if the compressed compressible ball 5 is released, the rolling ball 133 will be sucked backward to the inside of the expansion hole 131 such that the rolling ball 133 can block the perfume liquid to prevent it from flowing into the gas-supplying tube 13 and even into the inside of the compressible ball 5.

The improved spray head structure can prevent the perfume liquid from backflow during the compression operation of the compressible ball 5. In addition, the stability of the mist can be increased by avoiding the backflow of the perfume liquid.

What the invention claimed is:

1. A spray head structure capable of preventing backflow of perfume liquid, comprising:

a spray head, a locking base, a kit, a bottle, and a compressible ball, wherein the locking base is coupled to the bottle and the locking base has a trench formed thereon for holding the kit, wherein the locking base is covered with an outer cover and the kit is fixedly inserted into the locking base such that the kit is coupled with the spray head, wherein the spray head has a horizontal tunnel and a vertical tunnel, which are connected to one another, wherein the horizontal tunnel is designed for holding a gas-supplying tube, a gas-guiding device, and a spray nozzle, wherein the spray nozzle is located on one side of the horizontal tunnel, and the gas-supplying tube has a through inside and an expansion hole on one side, wherein a guide surface is formed on an outer edge of the expansion hole, and a rolling ball is held in the expansion hole and movably located inside the gas-supplying tube, wherein the gas-guiding device is inserted into the expansion hole and coupled with the gas-supplying tube, and wherein a cross-shaped trench is formed on one end of the gas-guiding device, and liquid-guiding grooves are formed on the other end of the gas-guiding device.

2. The spray head structure of claim 1, wherein the cross-shaped trench of the gas-guiding device is coupled with the expansion hole, and the liquid-guiding grooves are coupled with the spray nozzle.

3. The spray head structure of claim 1, wherein the gas-supplying tube and the spray nozzle are not closely coupled with one another.

4. The spray head structure of claim 1, wherein a liquid channel is formed between the gas-guiding device and the spray nozzle, and the liquid channel is connected to the vertical tunnel of the spray head so as to provide the perfume liquid with a flow channel.

5. The spray head structure of claim 1, wherein a plurality of grooves are formed on an inner surface of the spray nozzle and connected to the liquid-guiding grooves of the gas-guiding device.

* * * * *